US011615739B1

(12) United States Patent
Kim et al.

(10) Patent No.: US 11,615,739 B1
(45) Date of Patent: Mar. 28, 2023

(54) FAST EXTERNAL PIXEL COMPENSATION IN A DISPLAY PANEL

(71) Applicant: Samsung Display Co., Ltd., San Jose, CA (US)

(72) Inventors: Kyunglok Kim, Belmont, CA (US); Amir Amirkhany, Sunnyvale, CA (US); Gaurav Malhotra, Cupertino, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/678,366

(22) Filed: Feb. 23, 2022

Related U.S. Application Data

(60) Provisional application No. 63/284,811, filed on Dec. 1, 2021.

(51) Int. Cl.
*G09G 3/32* (2016.01)

(52) U.S. Cl.
CPC ..... *G09G 3/32* (2013.01); *G09G 2320/043* (2013.01); *G09G 2360/16* (2013.01)

(58) Field of Classification Search
CPC . G09G 2320/043; G09G 2360/16; G09G 3/32
See application file for complete search history.

(56) References Cited

U.S. PATENT DOCUMENTS 10,741,114 B2 8/2020 Park
10,997,907 B2 5/2021 Baek et al.
(Continued)

FOREIGN PATENT DOCUMENTS

KR 10-2018-0065678 A 6/2018
KR 10-2190106 B1 12/2020

*Primary Examiner* — Muhammad N Edun
(74) *Attorney, Agent, or Firm* — Lewis Roca Rothgerber Christie LLP

(57) ABSTRACT

A method of compensating for change in pixel and a display device incorporating such method are presented. The method includes dividing pixels into groups including a previous group L−1, a current group L and a next group L+1; determining $A_{converged}[L]$ and $B_{converged}[L]$ for each pixel in the current group L; for each pixel in the current group L, determining a first moving average $A_{mean}[L]$ and a second moving average $B_{mean}[L]$ as follows:

$$A_{mean}[L] = \frac{A\ \text{mean}[L-1](K-1) + A[L]}{K},$$

$$B_{mean}[L] = \frac{B\ \text{mean}[L-1](K-1) + B[L]}{K},$$

wherein $A_{mean}[L-1]$ is a first moving average of a pixel in the corresponding column in the previous group L−1, $B_{mean}[L-1]$ is a second moving average of a pixel in the corresponding column in the previous group L−1, and K is a moving average window; and for the next group L+1, setting a first initial value $A_0[L+1]$ and a second initial value $A_0[L+1]$ of each pixel to $A_{mean}[L]$ and $B_{mean}[L]$.

20 Claims, 17 Drawing Sheets

(56) References Cited

U.S. PATENT DOCUMENTS

| | | | | |
|---|---|---|---|---|
| 11,030,939 | B2 | 8/2021 | Park et al. | |
| 2016/0307498 | A1* | 10/2016 | Chaji | G09G 3/3291 |
| 2019/0141268 | A1* | 5/2019 | Huang | H04N 9/045 |
| 2019/0197935 | A1* | 6/2019 | Kim | G09G 3/2092 |
| 2020/0258468 | A1 | 8/2020 | Chu et al. | |
| 2021/0074222 | A1* | 3/2021 | Meng | G09G 3/3275 |

* cited by examiner

| Gear Step | Minimum # of updates (WIN cycles) | Limit |
|---|---|---|
| 16X | 32 | 80 |
| 8X | 32 → 4 | 40 |
| 4X | 32 → 4 | 20 |
| 2X | 32 → 4 | 10 |
| 1X | 32 → 4 | 10 |
| 1X/2 | 32 → 8 | 10 |
| 1X/4 | 32 | 10 |

FIG. 11

| Gear Step | Minimum # of updates (WIN cycles) | Limit |
|---|---|---|
| 16X | 32 | 80 |
| 8X | 32 | 40 |
| 4X | 32 | 20 |
| 2X | 32 | 10 |
| 1X | 32 | 10 |
| 1X/2 | 32 | 10 |
| 1X/4 | 32 | 10 |

FIG. 12A

| Gear Step | Minimum # of updates (WIN cycles) | Limit |
|---|---|---|
| 8X | 4 | 40 |
| 4X | 4 | 20 |
| 2X | 4 | 10 |
| 1X | 4 | 10 |
| 1X/2 | 8 | 10 |

FIG. 12B

| Panel | Column | Adaptation Time w/ original LMS adaptation | Adaptation Time w/ fast LMS adaptation | Pixel Uniformity (Original, Green) | Pixel Uniformity (Updated, Green) |
|---|---|---|---|---|---|
| | Green | 120.23 | 8.63 | | |
| Panel 1 | Red/Blue | 148.65 | 8.93 | 91.5 | 91.3 |
| | Total | 268.88 (~ 4.5 hrs) | 17.56 | | |
| | Green | 117.55 | 10.02 | | |
| Panel 2 | Red/Blue | 126.13 | 10.80 | 92.3 | 92.5 |
| | Total | 243.68 (~ 4 hrs) | 20.82 | | |

FIG. 13

FAST EXTERNAL PIXEL COMPENSATION IN A DISPLAY PANEL

CROSS-REFERENCE(S) TO RELATED APPLICATION(S)

This application claims the benefit of U.S. Provisional Application No. 63/284,811 filed on Dec. 1, 2021, which is incorporated by reference herein.

BACKGROUND

This disclosure relates to active matrix display devices, and particularly to display devices having thin film switching transistors associated with each pixel.

Different types of active matrix display devices are known today, including but not limited to organic light emitting diode (OLED) devices and liquid crystal display (LCD) devices. FIG. 1 depicts an example of a conventional active matrix addressed display device that includes an array of pixels 1, each of the pixels 1 having a display element 2. As shown, the display device comprises a panel having a plurality of pixels 1 arranged in rows (L–1), L, (L+1), etc. and columns Although a small number of pixels 1 are shown in FIG. 1 for simplicity, a display panel comprises hundreds and thousands of pixels. The pixels 1 are driven by a row driver 8 and a column driver 9, which receive and process data from a signal controller 7 and transmit signals on scan lines S and data lines D.

The display panel may have current-addressed display elements 2. There are various ciruits for providing a controllable current through the display element 2, and each pixel 1 is configured to emit light based on a received current. The current that a pixel 1 receives is controlled by a driving transistor. To cause the pixel to output a particular color, a display device may apply a voltage to the gate of the transistor based on the particular color. A storage capacitor may be included to hold the gate voltage after the addressing phase.

Often, during operation, characteristics (e.g., mobility and voltage threshold) of the transistor may change (e.g., due to heat). Application of high voltages above the threshold voltage causes large changes in threshold voltage over time. As not all the pixels 1 are used the same way or stay on for the same amount of time, a large difference in the threshold voltages of transistors in different pixels may result. Accordingly, the transistor may output a first current value to the pixel responsive to a particular voltage value at a first time but output a second current value to the pixel responsive to the particular voltage value at a second time. The changes might not be consistent across the panel. Also, different drive transistors may have different characteristics due to manufacturing variation. These variations and differential aging may cause problems with the display device.

Given the large number of pixels in a display device, compensating for the transistor change for each pixel individually is a huge task. If temperature and ambient light change faster than the pixels can converge, there will be no convergence and no effective update. A fast and efficient method of dealing with the different changes of pixels in a display device is desired.

SUMMARY

A method of compensating for change in pixel performance is disclosed. The method entails dividing pixels into groups including a previous group L–1, a current group L and a next group L+1, determining a first converged value $A_{converged}[L]$ and a second converged value $B_{converged}[L]$ for each pixel in the current group L starting with a first initial value $A_0[L]$ and a second initial value $B_0[L]$, for each pixel in the current group L, determining a first moving average $A_{mean}[L]$ and a second moving average $B_{mean}[L]$ as follows:

$$A_{mean}[L] = \frac{A\ \text{mean}[L-1](K-1) + A[L]}{K},$$

$$B_{mean}[L] = \frac{B\ \text{mean}[L-1](K-1) + B[L]}{K},$$

wherein $A_{mean}[L-1]$ is a first moving average of a pixel in the corresponding column in the previous group L–1, $B_{mean}[L-1]$ is a second moving average of a pixel in the corresponding column in the previous group L–1, and K is a moving average window, and for the next group L+1, setting a first initial value $A_0[L+1]$ and a second initial value $B_0[L+1]$ of each pixel to $A_{mean}[L]$ and $B_{mean}[L]$.

In another aspect, the disclosure pertains to a display device that includes a plurality of pixels, each of the pixels including a light emitting element, wherein the light emitting element is coupled to a transistor that is controlled by a gate voltage $V_{gs}$; circuitry configured to adjust the gate voltage $V_{gs}$ by dividing pixels into groups including a previous group L–1, a current group L and a next group L+1, determining a first converged value $A_{converged}[L]$ and a second converged value $B_{converged}[L]$ for each pixel in the current group L starting with a first initial value $A_0[L]$ and a second initial value $B_0[L]$, for each pixel in the current group L, determining a first moving average $A_{mean}[L]$ and a second moving average $B_{mean}[L]$ as follows:

$$A_{mean}[L] = \frac{A\ \text{mean}[L-1](K-1) + A[L]}{K},$$

$$B_{mean}[L] = \frac{B\ \text{mean}[L-1](K-1) + B[L]}{K},$$

wherein $A_{mean}[L-1]$ is a first moving average of a pixel in the corresponding column in the previous group L–1, $B_{mean}[L-1]$ is a second moving average of a pixel in the corresponding column in the previous group L–1, and K is a moving average window, and for the next group L+1, setting a first initial value $A_0[L+1]$ and a second initial value $B_0[L+1]$ of each pixel to $A_{mean}[L]$ and $B_{mean}[L]$.

BRIEF DESCRIPTION OF THE DRAWINGS

FIG. 10A, FIG. 10B, FIG. 10C, FIG. 10D, and FIG. 10E depict compensation prameters, modified voltage, and gear size as they correlate with one another during adaptation, in accordance with an embodiment of the disclosure.

FIG. 11 depicts an example gear shift schedule table.

FIG. 12A depicts a gear shift table for the first line, and FIG. 12B depicts a gear shift table for subsequent lines for the same display.

FIG. 13 depicts the impact of the method of the disclosure on two example panels.

DETAILED DESCRIPTION

An adaptation method for faster pixel convergence is disclosed. The method according to the disclosure entails starting the adaptation process for a line or row of pixels using a converged value from the previous line or row. The method according to the disclosure further entails a dynamic gear shifting method that allows gear size to be changed after different numbers of sensing cycles depending on the rate of convergence of parameter values. For simplicity, a line/row of pixels are used as an example group of spatially correlated pixels in this description. However, it should be understood that a "group" of pixels is not restricted to being a single line of pixels, and may represent any number of pixels in different arrangements, according to spatial correlation in the display device.

Figure 2:
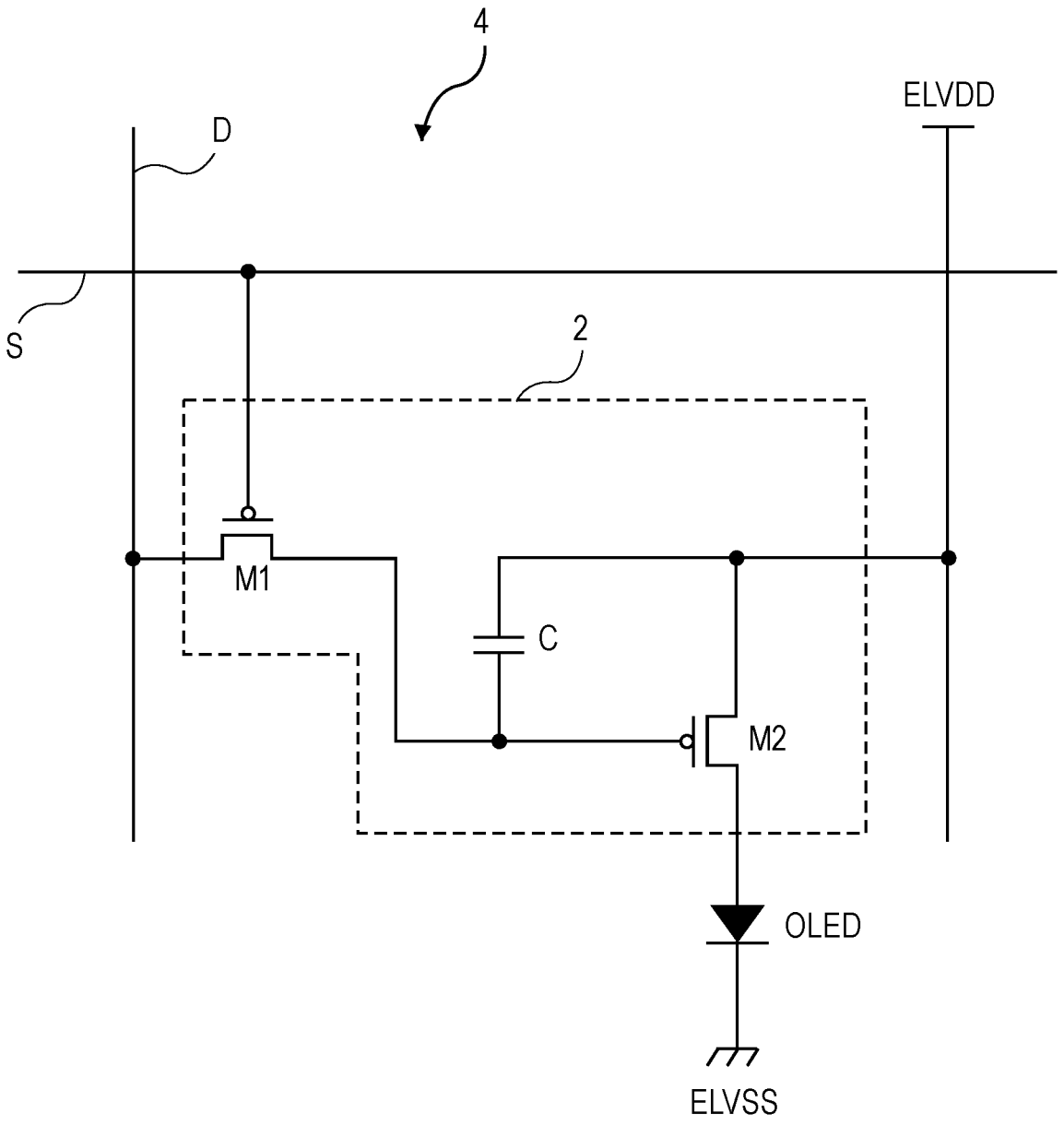
FIG. 2 depicts an example of a conventional photodiode OLED coupled to a drive transistor.

FIG. 2 depicts an example of a conventional photodiode OLED coupled to a drive transistor M2. The drive transistor M2 is controlled by the voltage on its gate, which is stored on a capacitor C during an addressing phase. During the addressing phase, the addressing transistor M1 is turned on, allowing the desired voltage to transfer from the data line D to the capacitor C to reach the drive transistor M2. The photodiode OLED discharges the gate voltage stored on the capacitor C. This way, the photodiode OLED will no longer emit when the gate voltage on the drive transistor M2 reaches the threshold voltage, and the storage capacitor C will stop discharging.

Transistor current that is output to the pixel ($I_{pixel}$) has the following relationship to gate voltage $V_{gs}$:

$$I_{pixel}=\mu k\,(V_{gs}-V_{th})^{\alpha} \quad \text{[Eq. 1]}$$

where k is a coefficient, μ is the mobility of the transistor, $V_{gs}$ is the gate voltage, and $V_{th}$ is the threshold voltage. Of the variables, mobility μ and threshold voltage $V_{th}$ are specific to each individual transistor in the display device. Moreover, mobility μ and threshold voltage $V_{th}$ of a single transistor also change with time and usage, for example due to temperature variation. Hence, over time and temperature changes, transistor characteristics between pixels can vary widely. Equation 2 takes into account difference in mobility Δμ and difference in threshold voltage $\Delta V_{th}$ between pixels. Equation 2 also tracks the changes in mobility μ and threshold voltage $V_{th}$ with time.

$$I_{pixel}=(\mu_0+\Delta\mu)k[V_{gs}-(V_{th0}+\Delta V_{th})]^{\alpha} \quad \text{[Eq. 2]}$$

The model of Eq. 1 may not accurately predict the behavior of pixels as the size of the pixel transistor gets smaller and new material is introduced in transistor fabrication. To compensate for mismatches in mobility μ and threshold voltage $V_{th}$ among different pixels on a same panel, the following model may be used:

$$I_{pixel}=\mu k(AV_{gs0}+B-V_{th})^{60} \quad \text{[Eq. 3]}$$

where $V_{gs}=AV_{gs0}+B$(LMS algorithm)

Combining Eq. 2 with Eq. 3 yields the following:

$$I_{pixel}=(\mu_0+\Delta\mu)k(AV_{gs0}+B-(V_{th0}+\Delta V_{th}))^{\alpha} \quad \text{[Eq. 4]}$$

Although [Eq. 4] shows $I_{pixel}$ as a non-linear function of $V_{gs0}$, LMS adaptation may work for finding parameters A and B. In one embodiment, initial parameter values $A_0$ and $B_0$ may be set at 1 and 0, respectively. They are updated by testing a randomly chosen $V_{gs0}$ in a set to see how the values of A, B, when used with the chosen $V_{gs0}$, affect $I_{pixel}$.

Figure 3A:
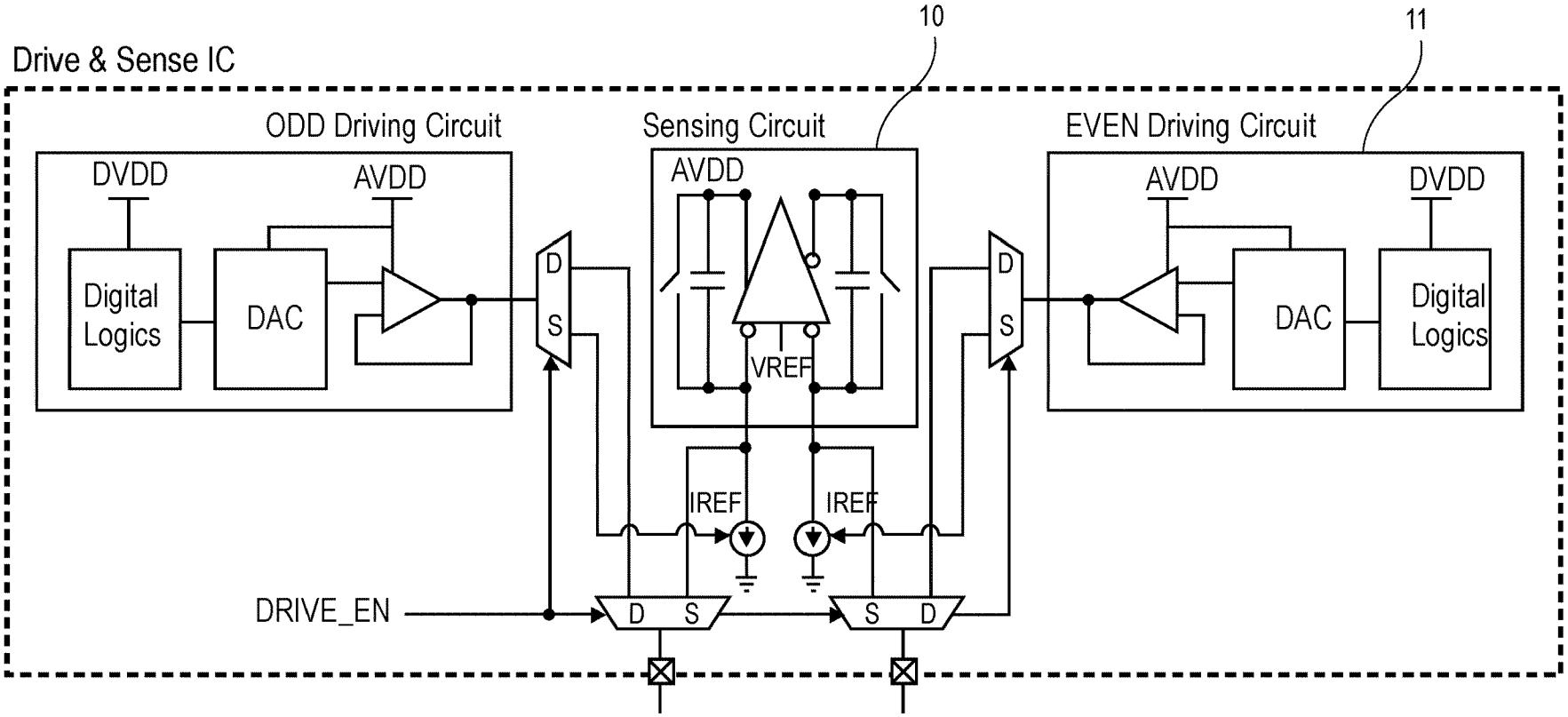
FIG. 3A depicts one example of the sensing front end (SFE) circuitry that is incorporated into a display device.
Figure 3B:
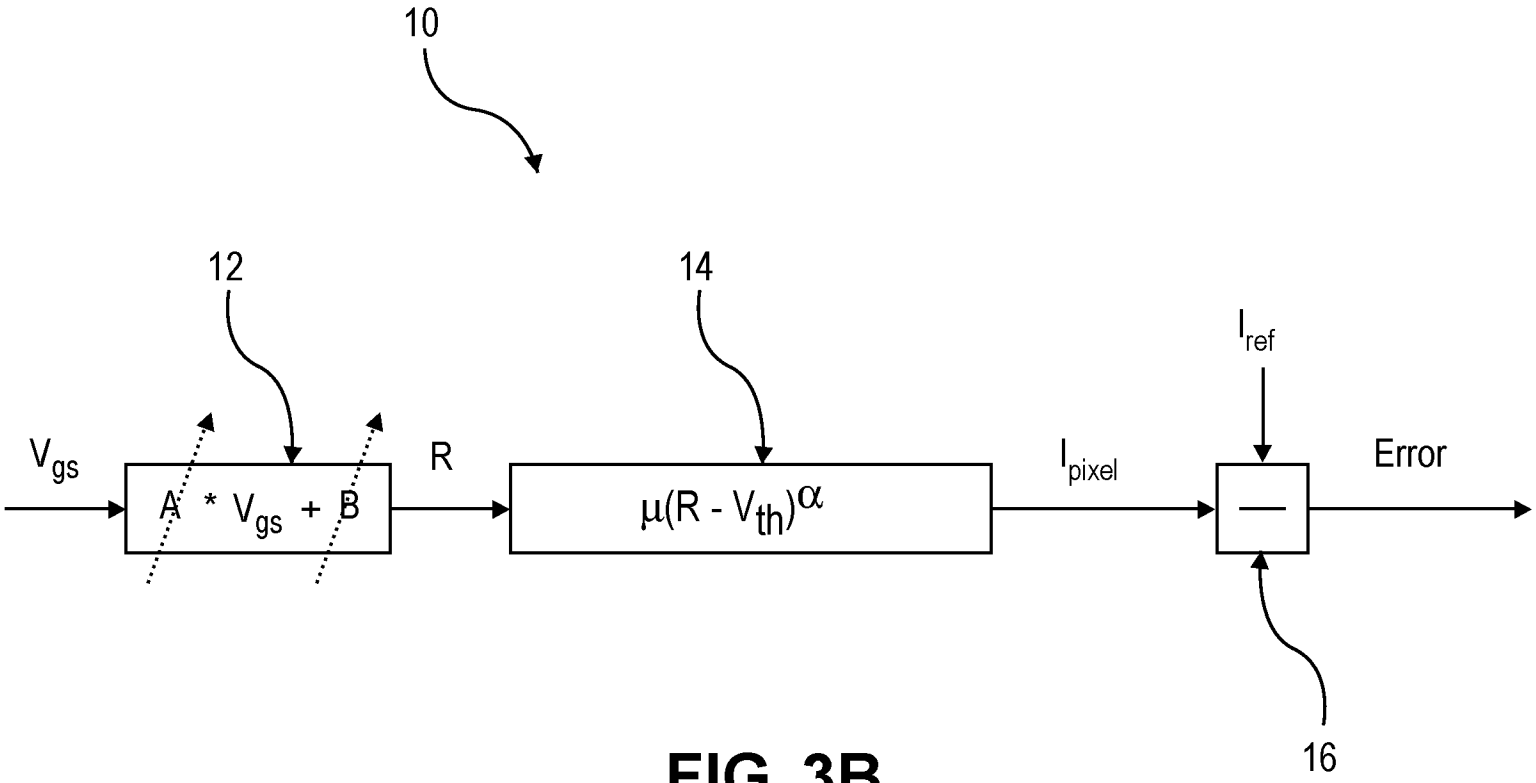
FIG. 3B depicts a sensing circuit that may be incorporated into a display device.

FIG. 3A depicts one example of the sensing front end (SFE) circuitry that is incorporated into a display device, for example in column driver 9. As shown, the sensing front end circuitry includes a sensing circuit 10 and a driving circuit 11. FIG. 3B depicts an example of the sensing circuit 10 that is configured to compare a pixel current ($I_{pixel}$) output to a reference current ($I_{ref}$) to generate an error (Error). The reference current $I_{ref}$ is current of a predetermined value (e.g., 1 nA) that may be generated by a sensing front end (SFE) circuitry . As shown in FIG. 3B, the drive transistor M2 of a pixel receives an input voltage $V_{gs}$ to drive the pixel. Based on the error (Error), a compensation unit 12 of the display device adjusts an input voltage $V_{gs}$, which may correspond to a voltage applied to data line D, to generate a modified voltage (R). The compensation unit 12 of the front-end sensing circuit 10 outputs the modified voltage R to the gate of the drive transistor M2, to be used in place of $V_{gs}$ in the sensing circuit 10. A pixel current determination unit 14 uses the modified voltage R to determine the pixel current $I_{pixel}$ using mobility (μ), threshold voltage ($V_{th}$), and exponent (α) according to a standard transistor model. A comparator unit 16 compares the pixel current $I_{pixel}$ with the reference current $I_{ref}$ to generate an error (Error), which gets fed back to the compensation unit 12. Some components depicted in FIG. 3B may be outside the sensing circuit 10 in other embodiments.

Figure 1:
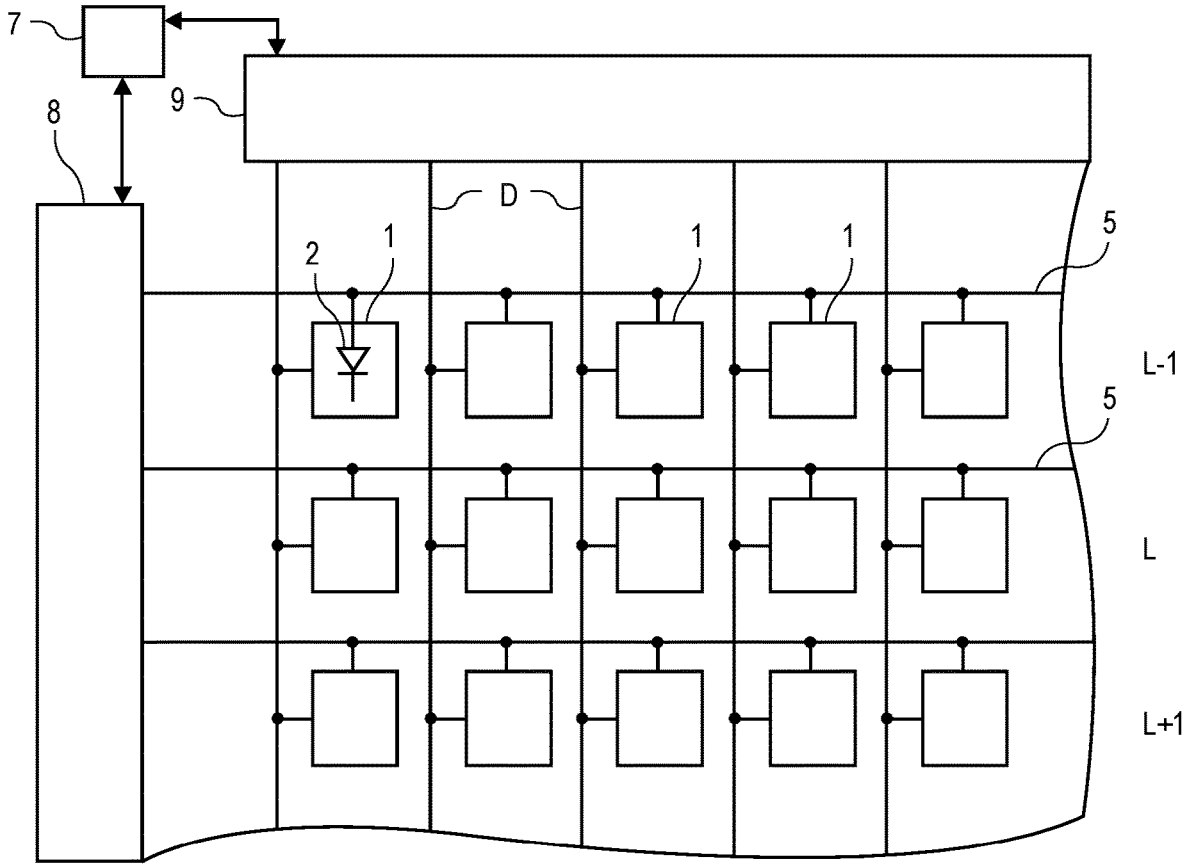
FIG. 1 (PRIOR ART)
FIG. 1 depicts an example of a conventional active matrix addressed display device.

In the example of FIG. 3B, the modified input voltage R into the drive transistor M2 is determined as follows:

$$R=A*V_{gs}+B, \quad \text{[Eq. 5]}$$

where A and B are compensation parameters. The compensation unit 12 may iteratively adjust the first parameter A and the second parameter B until the current output to the pixel ($I_{pixel}$) converges to the reference current ($I_{ref}$). Accordingly, color output by the pixel may converge to a desired level. In FIG. 3B, the broken arrows over A and B in FIG. 1 indicate that the values of A and B are being updated by an adaptation circuit.

Eventually, compensation parameters A and B are optimized at values that compensate for the variation of μ and $V_{th}$ such that $I_{pixel}$ stays the same across pixels for a given $V_{gs0}$. That is, A and B are tuned to fulfill the following ideal cases:

$$B-(V_{th0}+\Delta V_{th})\approx -AV_{th0}A^{a}\approx 1+\frac{\Delta\mu}{\mu_0}$$

A and B fulfilling the ideal case conditions results in $I_{pixel}$ becoming independent of $\Delta\mu$ and $\Delta V_{th}$, as follows:

$$I_{pixel}=(\mu_0+\Delta\mu)k'(AV_{gs0}-AV_{th0})^{\alpha}$$

$$I_{pixel}=(\mu_0+\Delta\mu)k'A^{\alpha}(V_{gs0}-V_{th0})^{\alpha}$$

$$I_{pixel}=\mu_0 k(V_{gs0}-V_{th0})^{\alpha} \quad \text{[Eq. 6]}$$

In some cases, at least four pairs of $V_{gs0}$ and $I_{pixel}$ are used to tune A and B.

Actual LMS adaptation may be simplified for easy implementation with digital logic, as follows:

$$A[n]=A[n-1]+\text{sign}(D_{in}[n-1])*\Delta A$$

$$B[n]=B[n-1]+\text{sign}(D_{in}[n-1])*\Delta B$$

wherein:

A[n−1] and B[n−1] are parameters A and B at sense measurement cycle (n−1);

A[n] and B[n] are parameters A and B at sense measurement cycle n;

$D_{in}$[n−1] is 1 when $I_{pixel}$ at cycle (n−1) is less than the desired value, 0 otherwise (D being the difference);

sign (X) is +1 when X>0, −1 otherwise; and

ΔA and ΔB are step size of A and B, respectively, for each change per cycle.

Often, calibration is done to make sure the outcome is accurate. Least Mean Square (LMS) adaptive process, among other methods, may be used to calibrate the pixels so that $I_{pixel}$ is substantially constant. However, running the LMS process on each individual pixel of a display device and converging each pixel to a compensation factor may take too much time. For example, a pentile 120 Hz QHD display has 1560×1440 pixels. If each pixel had two sub-pixels, the number of sub-pixels would equal 4,492,800. Assuming a frame time of around 8.33 milliseconds, and assuming that each pixel requires 100 senses to converge, about 1% of the pixels may be sensed every frame. It would take 100×100 frames for all the pixels to converge, which would take 83 seconds at 120 Hz. Eighty-three seconds is a long time for temperature and ambient light to remain constant on a display device. Conditions within the display device (e.g., temperature) may change before pixels converge, resulting in inaccurate pixel outputs. In mass production, calibration time of less than 10 seconds is desired. The system and method disclosed herein overcome this issue by achieving a faster convergence.

In this disclosure, a method that reduces LMS adaptation or convergence time that is simple enough to be implemented without much extra hardware or cost is presented. In one aspect, the method entails using converged values of previous lines to set an initial value for a next line to shorten the convergence time. In another aspect, a smart gear-shifting technique is presented that allows gear shifting to happen at a desired time without waiting for a preset number of sensing operations.

Figure 4A:
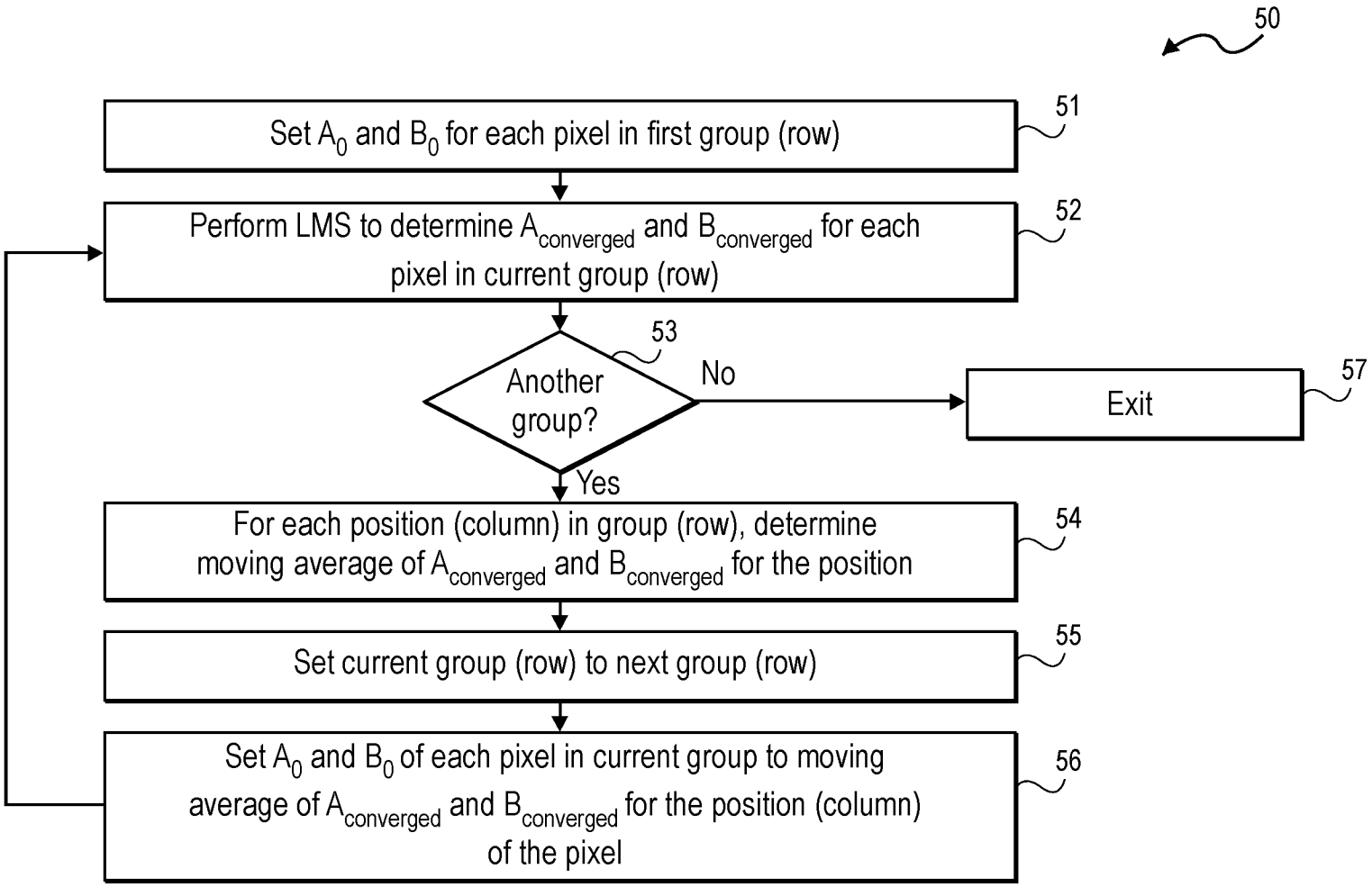
FIG. 4A depicts a flowchart for a fast external pixel compensation process in accordance with an embodiment of this disclosure.

FIG. 4A depicts a flowchart for a fast external pixel compensation process 50 in accordance with an embodiment of this disclosure. As shown, the process 50 starts by setting $A_0$(L−1) and $B_0$(L−1) for the first group/row (block 51), usually to a predetermined value such as 0 or 1. Then, LMS is performed to determine a first converged value $A_{converged}$ and a second converged value $B_{converged}$ for each pixel in a current group/row (block 52). If there is another group/row to process (block 53), the moving average of the first converged value $A_{converged}$ and the second converged value $B_{converged}$ are determined for each position/column in the group (block 54). Where a group is a row, the moving average of the first converged value $A_{converged}$ and the second converged value $B_{converged}$ are determined for each columnn in the row. Where the previous group/row (L−1) is the very first group/row, a first moving average $A_{mean}$ [L−1] is determined to be the same as the first converged value $A_{converged}$ (i.e., $A_{mean}$[L−1]=A[L−1]). Similarly, where the previous group/row is the very first group/row, a second moving average $B_{mean}$[L−1] is determined to be the same as the second converged value $B_{converged}$ (i.e., $B_{mean}$ [L−1]=B [L−1]). For all other groups/rows, a moving average (herein used interchangeably with "mean") may be determined as follows:

$$A_{mean}[L]=\frac{A\ \text{mean}[L-1](K-1)+A[L]}{K}, \quad \text{[Eq. 7a]}$$

$$B_{mean}[L]=\frac{B\ \text{mean}[L-1](K-1)+B[L]}{K}, \quad \text{[Eq. 7b]}$$

wherein K is a moving average window (a space window index that iterates over pixel group) and L is the pixel group number (e.g., row number). A[L] and B[L] are converged values for group/row L. Potentially, A[L] and B[L] are different for each pixel in a group/row L.

In block 55, the operation moves to the next group/row (the current group L in this example). The initial parameters $A_0$[L] and $B_0$[L] of each pixel in the group/row L is set to the moving average $A_{mean}$ of the first converged value $A_{converged}$ and the moving average $B_{mean}$ of the second second converged value $B_{converged}$ for the position/column of that pixel (block 56). Using a moving average of converged values from previous groups (e.g., L−1) as initial values for a current group (e.g., L) results in faster convergence for pixel compensation. Moving average is used primarily for initial, starting values of a new group, not used for subsequent iterations. When the LMS process is performed for all the groups/rows, the process 50 terminates (block 57).

Figure 4B:
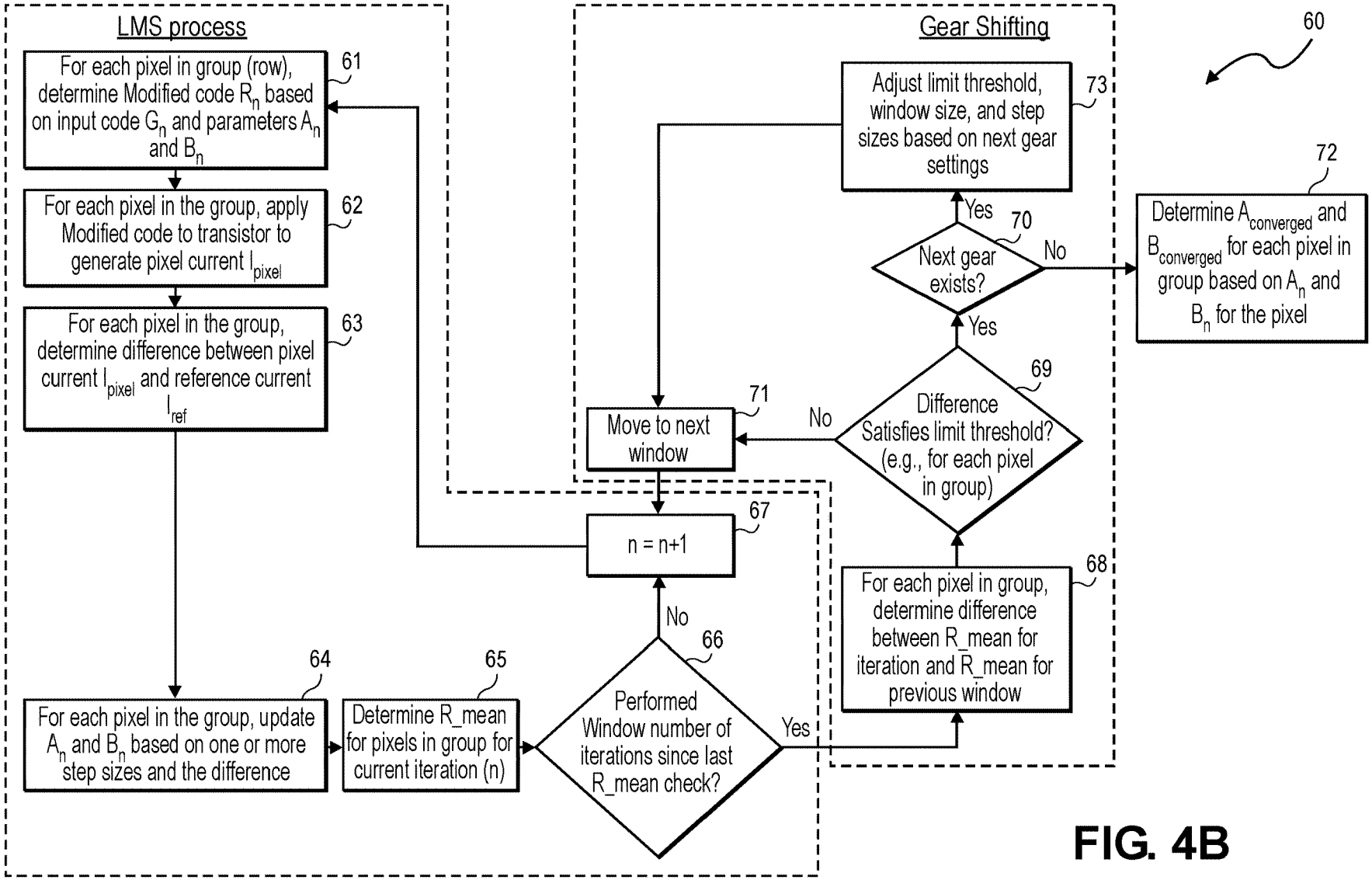
FIG. 4B depicts a flowchart for a Least Mean Square process with modified gear shift in accordance with an embodiment of this disclosure.

FIG. 4B depicts a modified LMS process 60, which includes an LMS process with modified gear shifting that is briefly shown in block 52 of FIG. 4A. FIG. 4B depicts the LMS process on the lefthand side and the modified gear shifting process on the righthand side. For each pixel in a group/row L, the modified code $R_n$, which is the parameter being converged, is determined based on input code $G_n$ (which may be $V_{gs}$) and compensation parameters $A_n$ and $B_n$ (block 61). A generic equation for LMS compensation may be as shown below:

$$R_n=A_n*G_n+B_n \quad \text{[Eq. 8]}$$

wherein $A_n$ and $B_n$ are parameters, $G_n$ is an input parameter (such as voltage $V_{gs}$), and Rn is the parameter being converged (e.g., a modified voltage). The moving average $R_{mean,n}$ gets settled at the converging value of $R_n$. The slope of $R_{mean,\ n}$ is related to the size of the gear, which affects speed of convergence. As used herein, the subscript "n" indicates one iteration for pixel, and the subscript "n+1" indicates a next iteration for the same pixel. If pixel parameters change faster than the time it takes for the parameters A and B to converge, the algorithm never converges. Hence, the speed at which convergence is reached affects how much benefit is derived from the voltage adjustments.

In block 62, the pixel output $I_{pixel}$ is calculated for each $R_n$, for each cycle n. For example, Eq. 6 above may be used with $R_n$ replacing $V_{gs0}$ For each pixel in the group, the difference between pixel current $I_{pixel}$ and reference current $I_{reference}$ is determined (block 63). For each pixel in the group/row, $A_n$ and $B_n$ are updated based on one or more step size and the difference ($I_{pixel}-I_{ref}$) (block 64). In block 65, the moving average of $R_{mean,\ n}$ may be determined as follows:

$$R_{mean,\ n}=R_{mean,\ n-1}-(R_{mean,\ n-1}/2^N)+(R_n/2^N) \quad \text{[Eq. 9]}$$

wherein N is the number of gear step changes, and $2^N$ indicates the number of pixels per line. The slope of $R_{mean}$ is checked for multiple pixels on a line. As indicated by block 66, the iterative process continues until WIN number of iterations have been performed since the last $R_{mean}$ check. More specifically, in block 66, if it is determined that the WIN number of iterations has not been performed, then another iteration is done (block 67) and blocks 61 through 66 are repeated until block 66 determines that the WIN number of iterations has been performed. WIN is a time window index indicating the number of operations per pixel.

If a predetermined WIN number of iterations has been performed since last $R_{mean}$ check (block 66), then for each pixel in the group/row, $R_{diff}$ is determined as follows (block 68):

$$R_{diff}=\text{abs}(R_{mean,\ n}-R_{mean,\ (n-WIN+1)}].$$

If $R_{diff}<\text{Limit}_n$, e.g. for each pixel in the group (block 69), and there is a next gear size (block 70), then the gear size is changed (e.g., to a smaller gear) and the limit threshold, window size, and step sizes are adjusted according to the new gear settings (block 73). The process progresses to the next window (block 71). In a conventional binary gear shift method, a gear is held for a fixed number of sensing operations before being switched to another gear. The conventional binary gear shift method does not allow the gear to be switched faster or slower, and have to go through the fixed number of sensing operations even if the number is clearly too high for some situations. The adaptive gear shift method of the present disclosure allows gear shift in a more optimized manner, based on $R_{diff}$.

If, in block 70, it is determined that there is no "next size gear," then the first converged value $A_{converged}$ and the second converged value $B_{converged}$ are determined for each pixel in the group/row based on the last parameter values $A_n$ and $B_n$ for the pixel.

As used herein, "WIN sensing" refers to the preselected number of sensing cycles that are required before a gear change is allowed. The first and second converged values $A_{converged}[L]$ and $B_{converged}[L]$ may be used to set a first initial value $A_0[L+1]$ and a second initial value $B_0[L+1]$ in block 56, for the next group L+1. Block 52, or the LMS process 60 depicted in FIG. 4B, repeat for all the groups/rows in the display. In the LMS process 60, modifying the values of the first parameter $A_n$ and the second parameter $B_n$ is done based on the step/gear size, which takes into account the difference between $I_{pixel}$ and $I_{reference}$. More specifically, the step/gear size is determined based on a moving average of modified volrages $R_{mean,\ n}$ for the pixel in group/row L. In one example, the step size may be adjusted in response to a change in the moving average of the modified input codes (e.g., voltages) relative to a predefind limit. The step size correlates with the predefined limit, as will be described in detail in reference to FIG. 11 below.

Figure 5A:
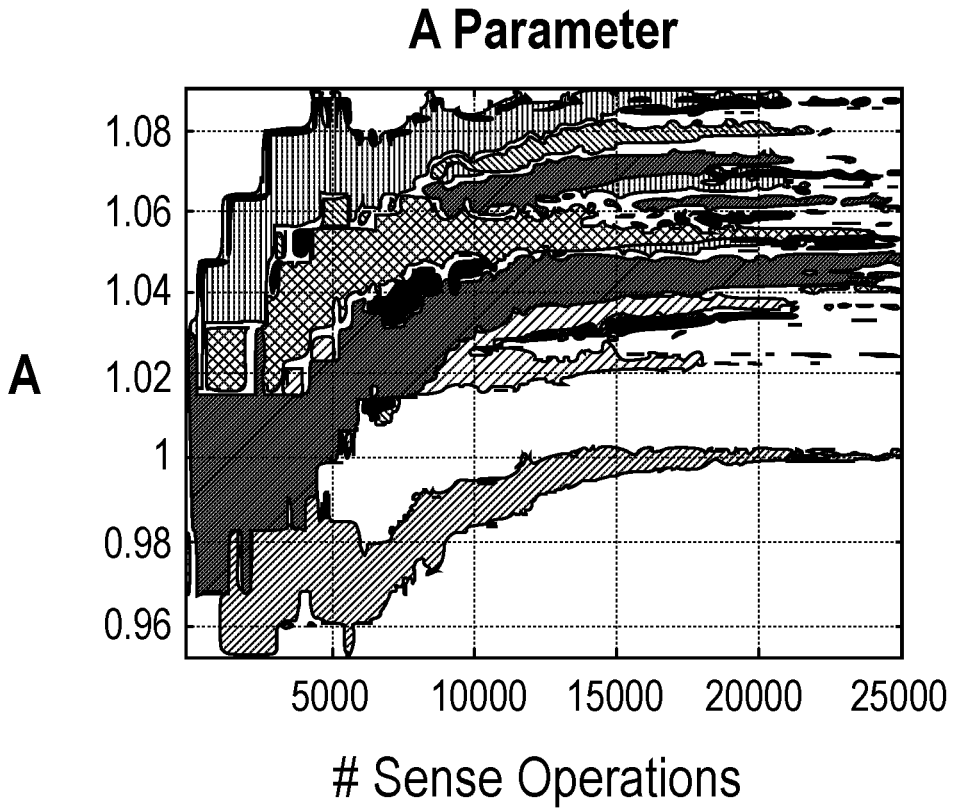
FIG. 5A and FIG. 5B depict compensation parameter values as a function of iteration cycles wherein the same initial values are applied to every line.
Figure 5B:
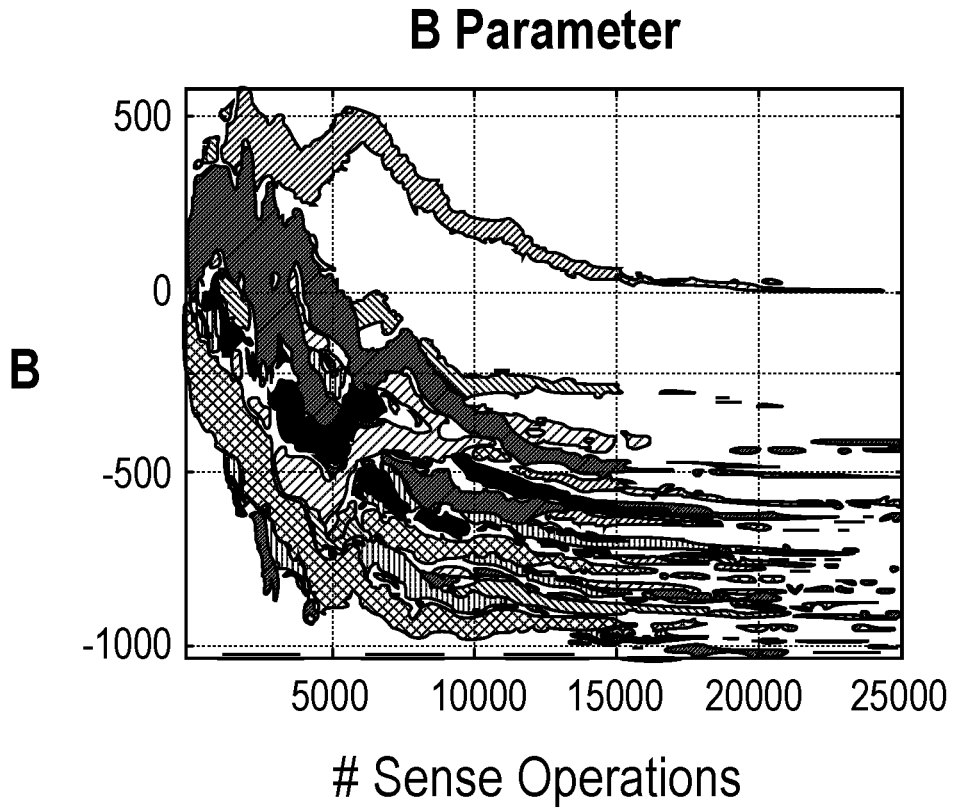

A typical LMS adaptation process begins with preselected initial adaptation values $A_0$ and $B_0$ as the compensation parameters. In an embodiment where the pixels are grouped according to lines/rows, initial adaptation parameter values $A_0$ and $B_0$ are used for every line. With $A_0$ and $B_0$ as the starting point for every line, A and B converge after about 25000 sense cycles. FIG. 5A and FIG. 5B show that, using the technique of starting with $A_0$ and $B_0$ for every line, each line takes about 25000 cycles to converge, even though the final values are different. The different plot lines represent different lines. There is not much difference in the number of cycles it takes to converge for each line, compared to for the preceding line. Every pixel compensation takes a long time to converge due to repeating of the same redundant steps as the previous line. However, the converged A and B values of adjacent lines on the same column are often close to each other. This data suggests that instead of starting the next line with the same initial parameter values $A_0$, $B_0$ as the previous line, convergence could be reached faster by starting with an initial value that is based on the converged value of the previous group.

In accordance with an embodiment of the present disclosure, the first and second compensation parameters A, B are set at initial values $A_0$ and $B_0$, respectively, only for the first line/row of pixels. For lines following the first line, the initial compensation parameters A and B are not automatically set at $A_0$and $B_0$. Rather, initial compensation parameters A and B for line 2 are set at values that are based on the converged values of line 1, compensation parameters A and B for line 3 are set at values that are based on the converged values of line 2, etc. as described above in reference to FIG. 4A and FIG. 4B.

Figure 6A:
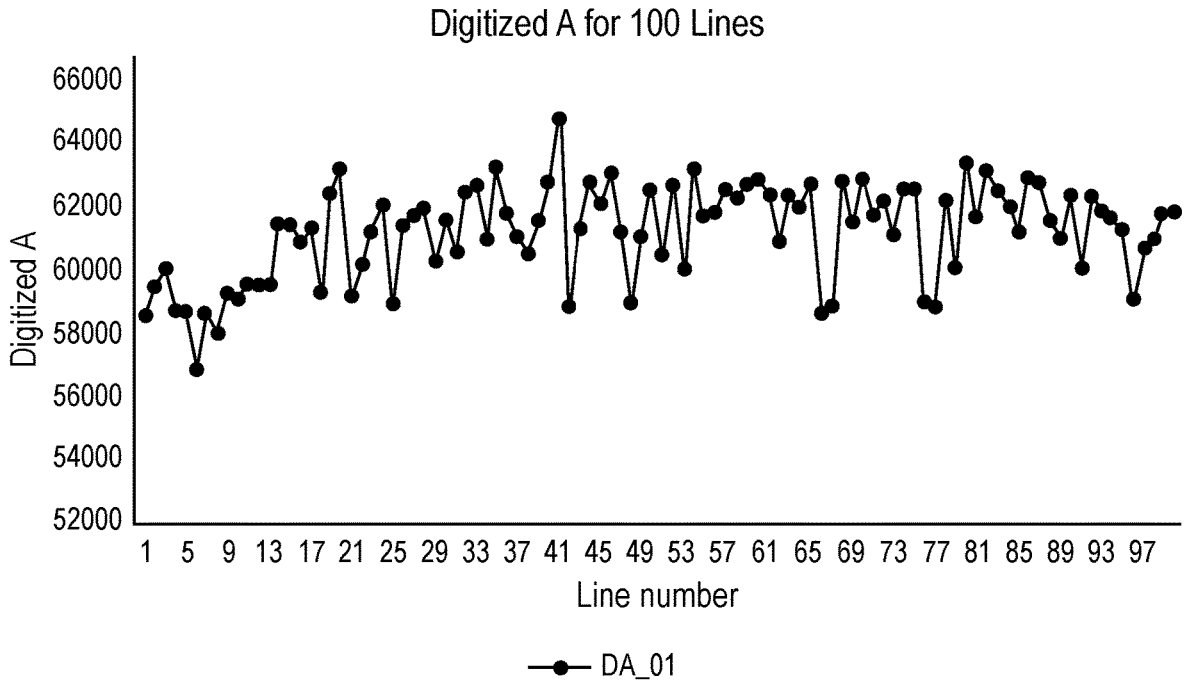
FIG. 6A and FIG. 6B depict digitized values of compensation parameters A and B from line 1 to line 100 of the same column after convergence.
Figure 6B:
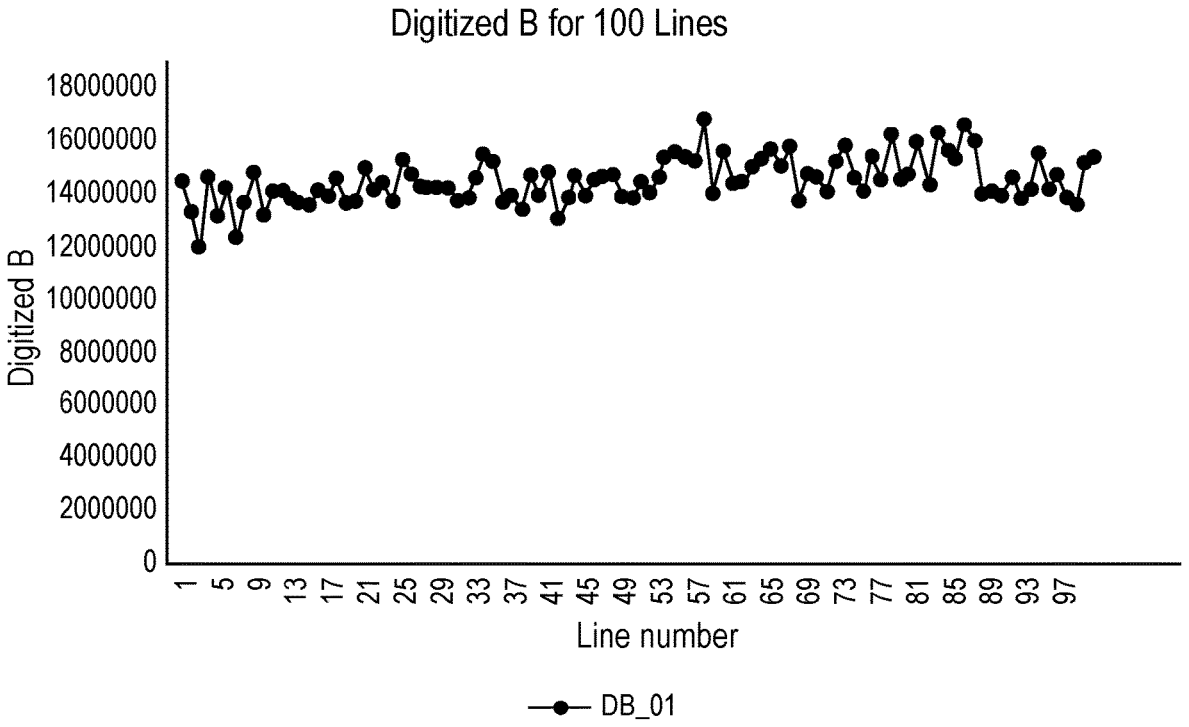

FIG. 6A and FIG. 6B depict digitized values of compensation parameters A and B from line 1 to line 100 of the same column after convergence. In this particular example, initial values $A_0$ and $B_0$ are set to one. The plots confirm that starting a next line with the final value of the preceding line is likely to result in faster convergence.

Figure 7:
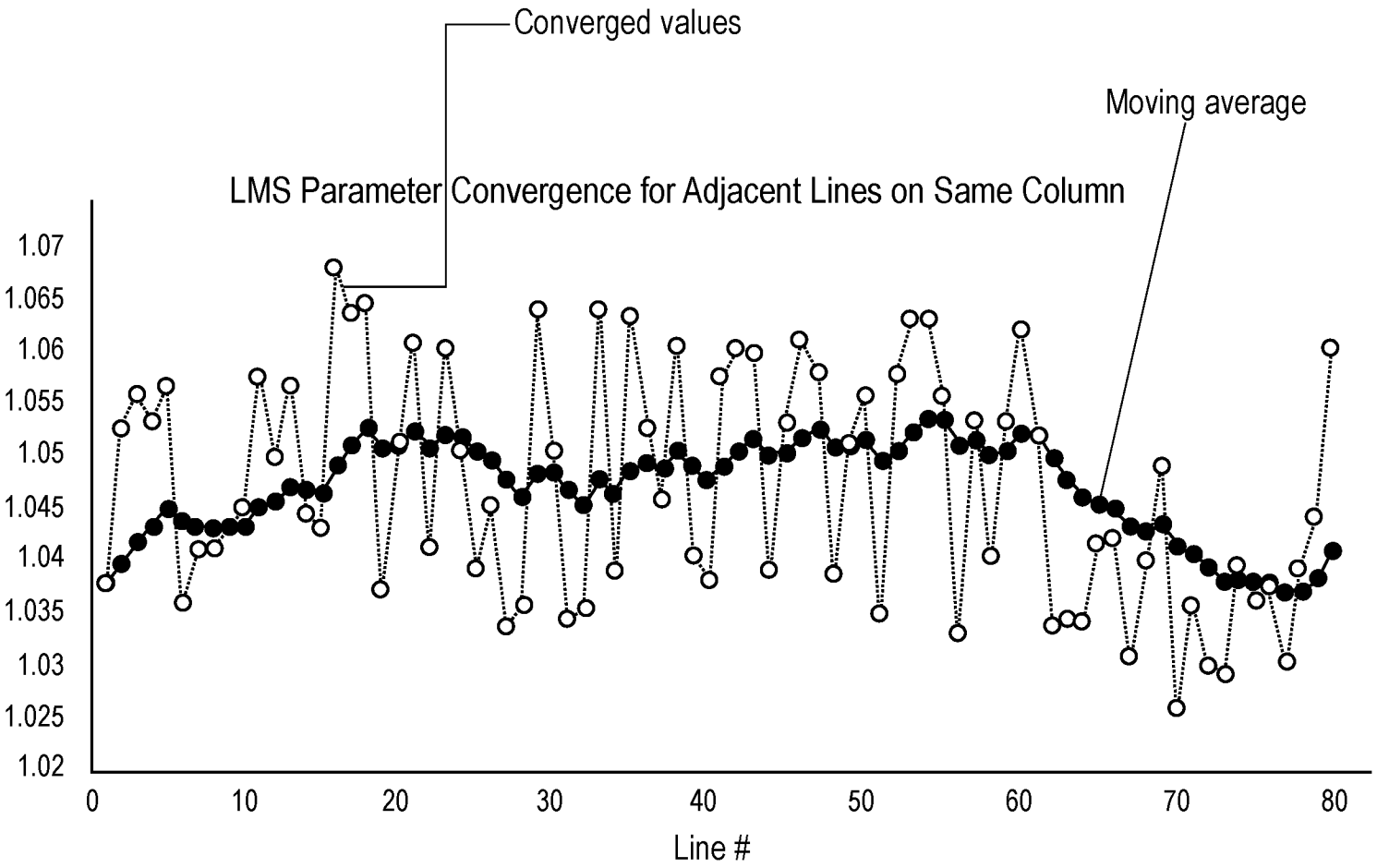
FIG. 7 depicts convergence for a compensation parameter A for 80 lines in the same column of a display where adaptation is done using the same initial parameter values for every line.

FIG. 7 depicts convergence for a compensation parameter A for 80 lines in the same column of a display where adaptation is done using the same $A_0$ and $B_0$ as initial values. The first plot line shows the converged values for each row. The second plot line, which shows the moving average for each row, results in smoother convergence with smaller fluctuations than the converged values.

Figure 8A:
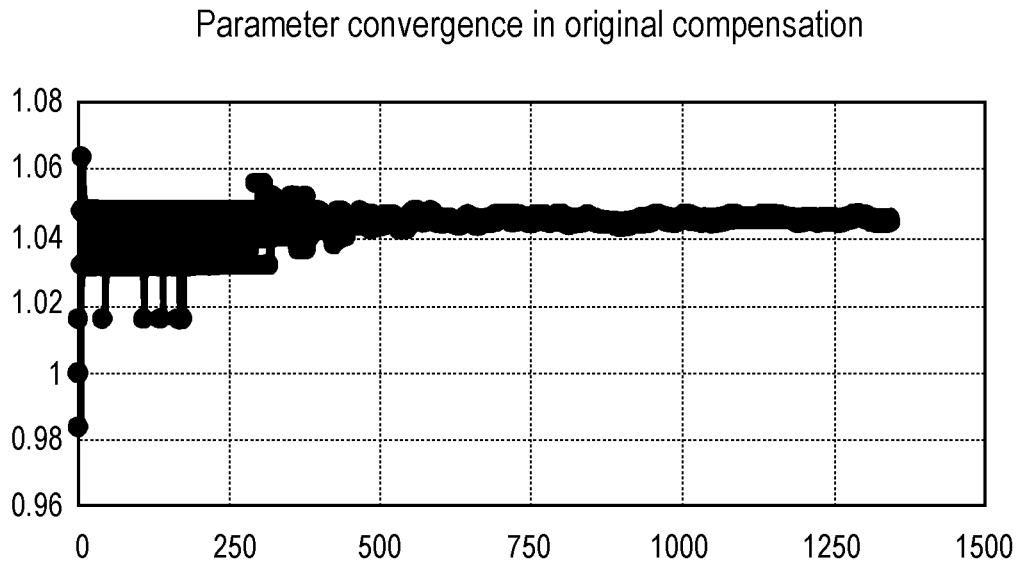
FIG. 8A depicts a display where adaption is done using initial values $A_0$ and $B_0$ for every row.
Figure 8B:
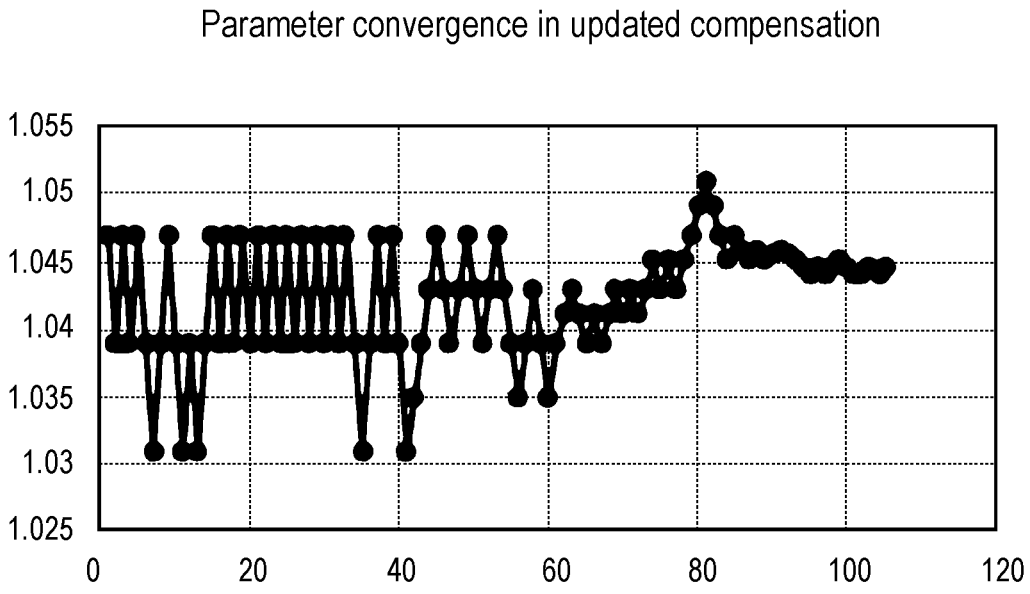
FIG. 8B depicts the case where adaption for non-first lines was done using the converged values of the former line(s) in accordance with an embodiment of the disclosure.

FIG. 8A depicts a display where adaption is done using initial values $A_0$ and $B_0$ for every row, and FIG. 8B depicts the case where adaption for subsequent lines was done using the converged values of the former line(s). In FIG. 8A, it took about 750-1000 cycles to reach convergence. In contrast, when using the converged values of preceding lines as the starting point of convergence for the next line, FIG. 8B shows convergence in about 100-120 cycles. In one embodiment, a moving average of previously convered A and B values may be used as initial values. Using a moving average of converged parameters from previous lines as initial values for a subsequent line results in faster convergence for pixel compensation, as demonstrated by FIG. 8A and FIG. 8B.

Figure 9:
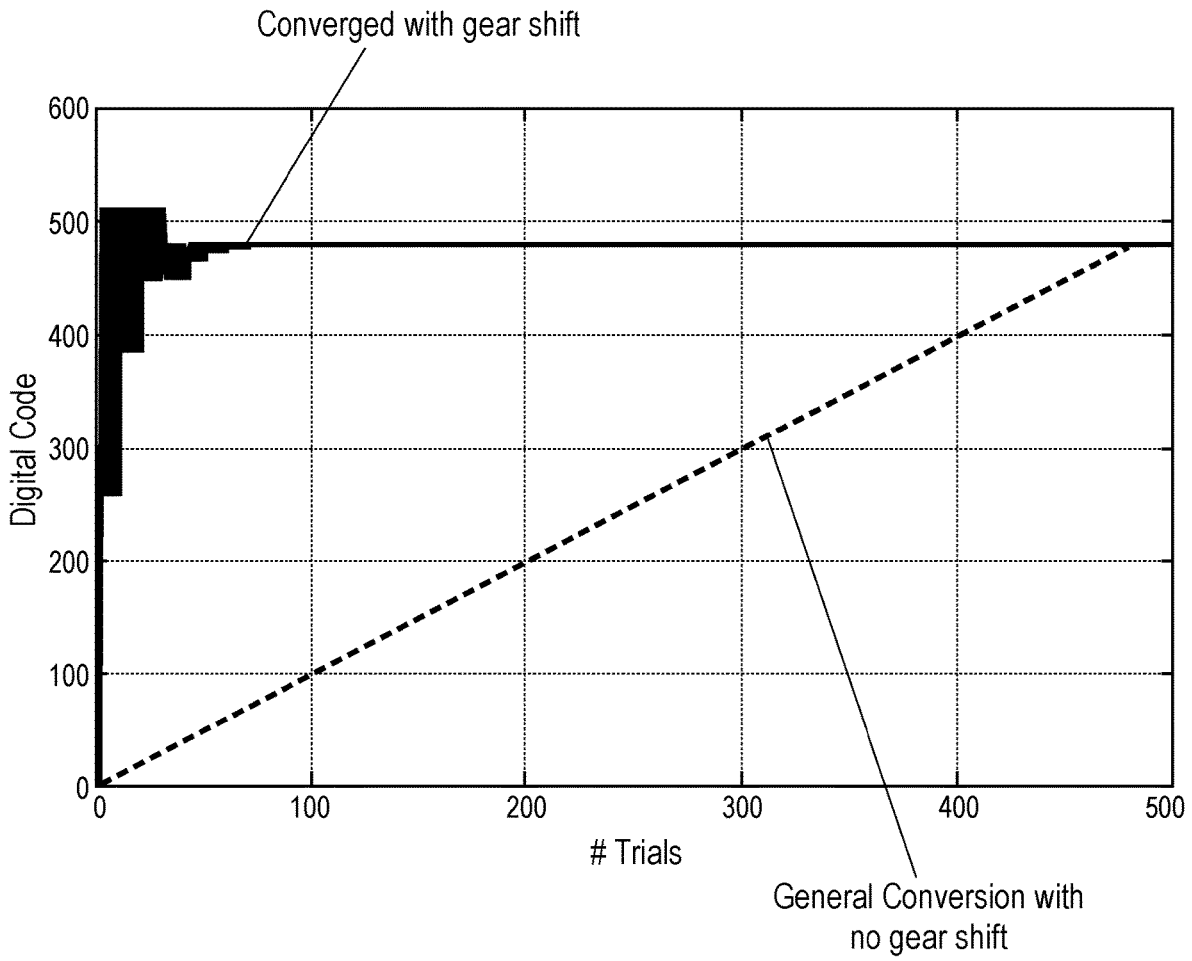
FIG. 9 depicts plot A that shows convergence with a conventional gear shift, and plot B that shows convergence with no gear shift.

To achieve an even faster LMS adaptation, a binary gear shift method may be utilized. FIG. 9 depicts plot A that shows convergence with a conventional gear shift, and plot B that shows convergence with no gear shift. As can be seen, the convergence with gear shift is achieved at about 80 cycles, whereas convergence without gear shift—but with previous-convergence-based initial parameter setting described above—took about 475 cycles. The gear shift technique reached convergence about 6 times faster than LMS with no gear shift.

Figure 10A:
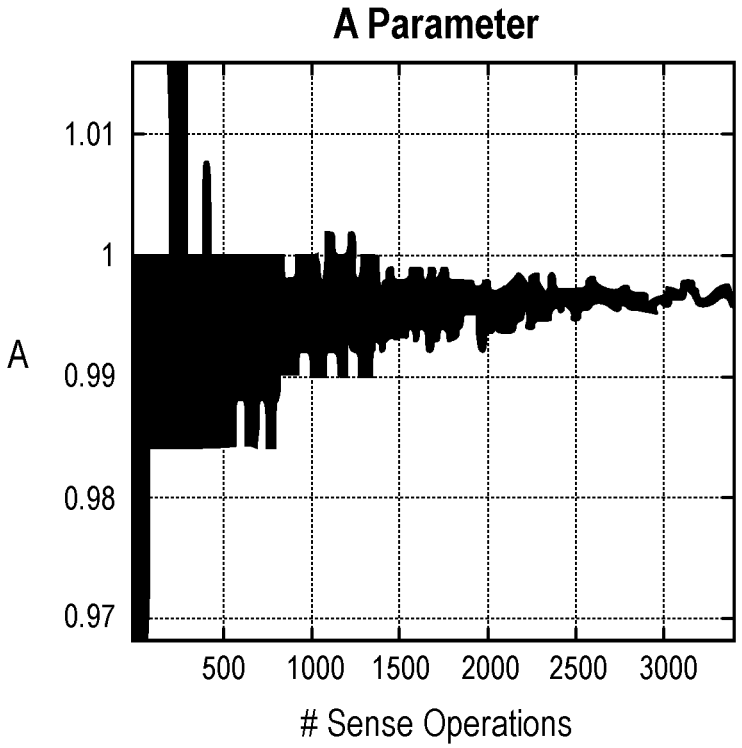
Figure 10A:
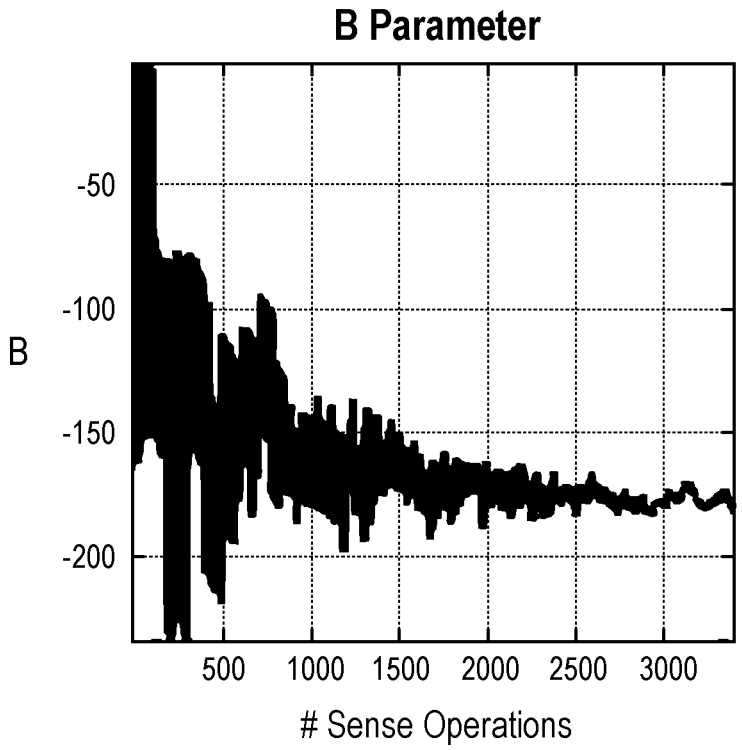
Figure 10C:
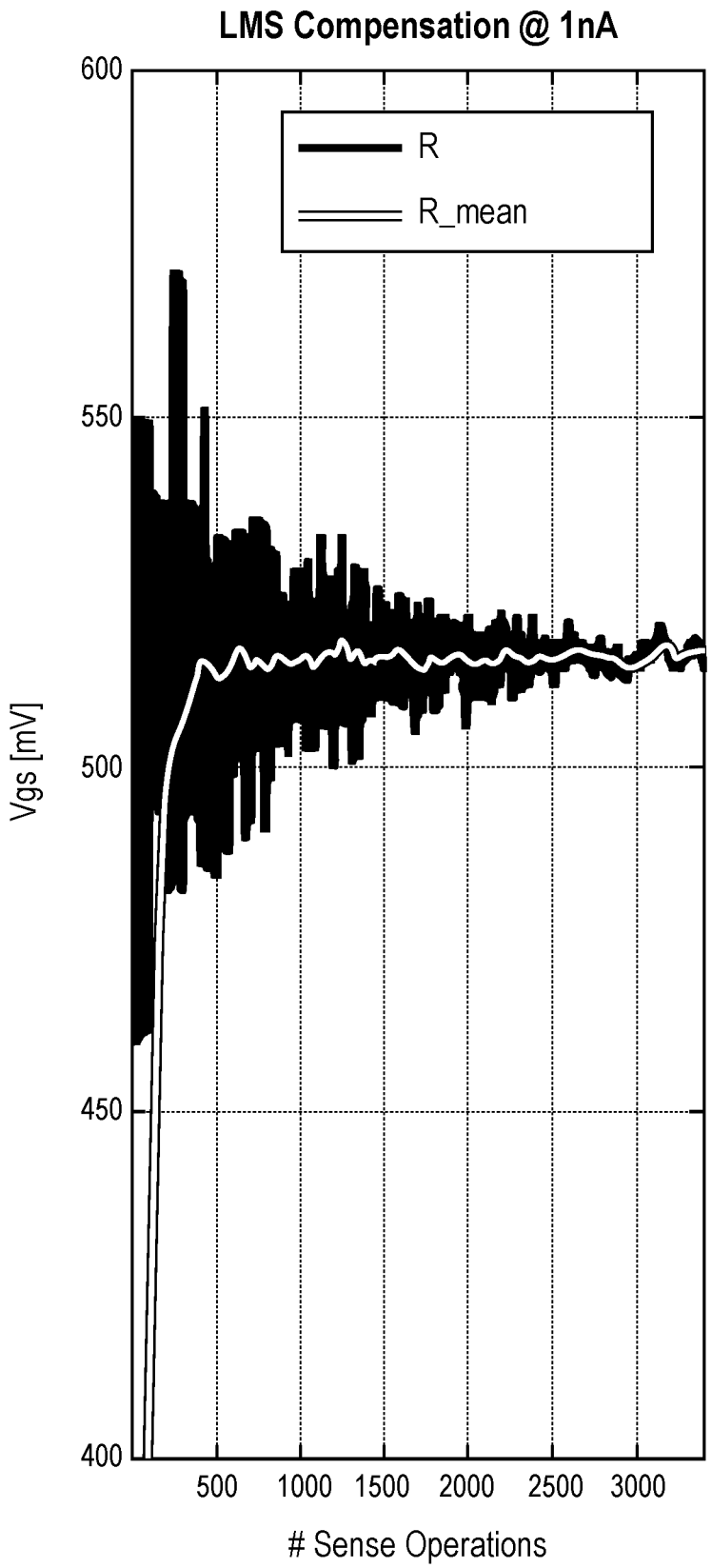
Figure 10D:
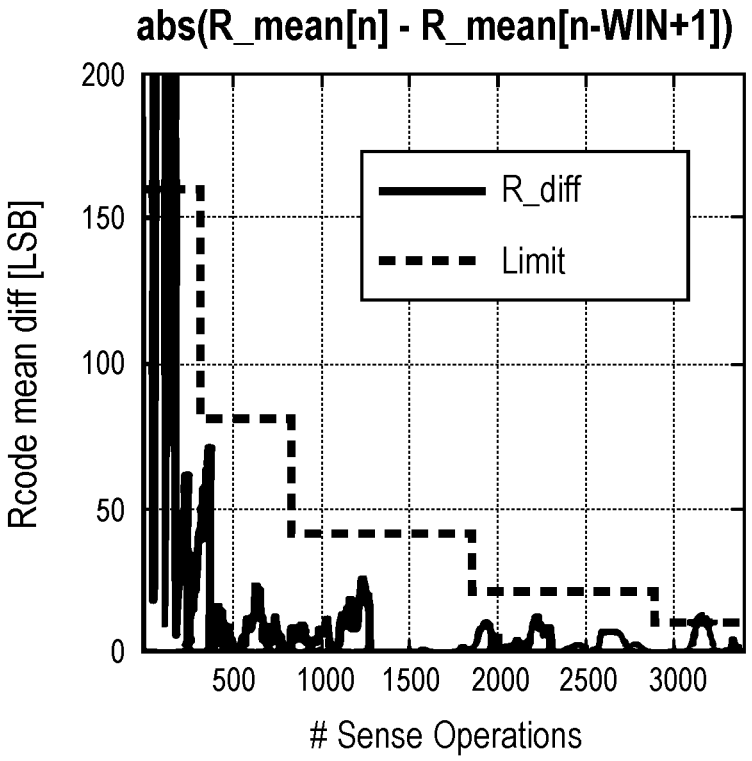
Figure 10E:
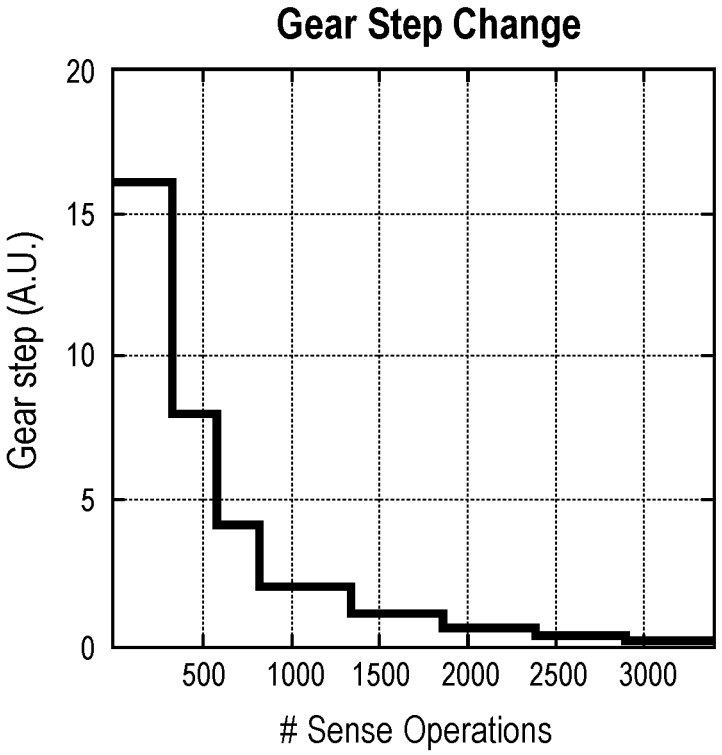

FIG. 10A and FIG. 10B depict convergence of compensation parameters A and B, while FIG. 10C depicts R[n] of Equation 8, which in this case is $V_{gs}$. FIG. 10D and depicts the value abs($R_{mean,\ n}-R_{mean,\ [n-WIN+1]}$), and FIG. 10E depicts the Gear Step Change. Although the five plots of FIG. 10A, FIG. 10B, FIG. 10C, FIG. 10D, and FIG. 10E are shown as separate plots for clarity, the y-axis values are taken along the same x-axis sense operations. While adaption of compensation parameters A and B is in progress, $R_n$ fluctuates heavily. However, as the compensation parameters A and B converge around 2500 sense operations, Vgs converges around 3000 sense operations. In the early part of the sense operations (<1000 cycles), the fluctuations of compensation parameters A and B are large. FIG. 10D shows that in the x-axis range of <1000 cycles, the absolute value quantity ($R_{diff}$) is large. The Limit[n] changes according to the fluctuations in $R_{diff}$. As shown in FIG. 10E, the gear step changes dramatically when the $R_{diff}$ value in FIG. 10D is large. However, as $R_{diff}$ decreases, so does the gear size. According to the rule in block 60 of FIG. 5, gear size goes down if $R_{diff}$<Limit[n]. As $R_{diff}$ is consistently below Limit [n] as depicted in FIG. 10D, the gear step size continually gets smaller throughout the plot.

FIG. 11 depicts an example gear shift schedule table. As shown, the gear size starts off large (16X), and Win cycle is set to 32 indicating that at least 32 cycles are run before the gear size is allowed to change, usually by one size down. Limit[n] indicates the maximum $R_{diff}$ value at which the gear size can go smaller So, after 32 cycles (where 32 is the minimum #of cycles), if $R_{diff}$ is equal to or larger than Limit[n], another 32 cycles are run. If, on the other hand, $R_{diff}$ is smaller than Limit[n], the gear size goes down to the next size, which in this case is 8X. 32 cycles happen, then the $R_{diff}$ is compared to Limit[n]. If $R_{diff}$<Limit[n], the gear size goes down to 4X. If, on the other hand, $R_{diff}$≥Limit[n], 32 cycles are run again before the comparison to Limit[n] is made again, for the first line (only 4 cycles are needed for a second and subsequent line). With the method of the disclosure where the initial compensation values of second line L is set based on the converged value of the first line (L−1), line L may start with the second largest gear size (8X in the table of FIG. 11). The finest gear or step size for line L may be ½X or ¼X in the example of FIG. 11. WIN cycles and Limit variables may be predetermined for each gear size, based on a heuristic process that takes into account environmental factors such as noise.

When the initial parameters of non-first lines are set using the converged parameters of the preceding line(s), the gear shift table may be different for the first line and the subsequent lines. FIG. 12A depicts a gear shift table for the first line, and FIG. 12B depicts a gear shift table for subsequent lines for the same display. As shown, the adaptation starts with a coarser or larger gear size for the first line than for the subsequent lines. More WIN cycles (32) are required for the first line than for a subsequent line (4). A wider range of gear sizes are available for the first line than for the other lines.

FIG. 13 depicts the impact of the method of the disclosure on two example panels. For Panel 1, use of the fast LMS method disclosed herein decreased the adaptation time for green pixels from 120.23 minutes to 8.63 minutes, and from 148.65 minutes to 8.93 minutes for red/blue pixels. This significant decrease in adaptation time is achieved without a significant effect on pixel uniformity (91.5% vs. 91.3%). Similarly, for Panel 2, use of the fast LMS method of the disclosure reduced the adaptation time from 117.55 minutes to 10.02 minutes for green pixels, and from 126.13 minutes to 10.80 minutes for red/blue pixels. As with Panel 1, this significant reduction in adaptation time is achieved without a noticeable degradation in pixel uniformity.

Accordingly, the disclosed systems and methods may set parameters used for pixel compensation for a pixel in a group (e.g., a row). Thus, the disclosed systems and methods may converge more quickly as compared to systems and methods that update each pixel in a display device based on errors detected for that pixel. The concepts disclosed herein may be applied to various types of display devices, including but not limited to organic light emitting diode (OLED) display devices and liquid crystal display (LCD) devices.

Aspects of the systems and methods provided herein can be embodied in programming Various aspects of the technology may be thought of as "products" or "articles of manufacture" typically in the form of machine (or processor) executable code and/or associated data that is carried on or embodied in a type of machine readable medium, such as a chip. Machine-executable code can be stored on an electronic storage unit, such as memory (e.g., read-only memory, random-access memory, flash memory) or a hard disk. "Storage" type media can include any or all of the tangible memory of the computers, processors or the like, or associated modules thereof, such as various semiconductor memories, tape drives, disk drives and the like, which may provide non-transitory storage at any time for the programming As used herein, unless restricted to non-transitory, tangible "storage" media, terms such as computer or machine "readable medium" refer to any medium that participates in providing instructions to a processor for execution.

The Least Mean Square calculation process may be implemented using a Field-Programmable Gate Array (FPGA) in the drive circuit (e.g., the sensing front end circuit) of a display device, or a computing device. A machine readable medium, such as computer-executable code, may take many forms, including but not limited to, a tangible storage medium, a carrier wave medium or physical transmission medium. Non-volatile storage media include, for example, optical or magnetic disks, such as any of the storage devices in any computer(s) or the like, such as may be used to implement the databases, etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a ROM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

While preferred embodiments of the present disclosure have been shown and described herein, it will be obvious to those skilled in the art that such embodiments are provided by way of example only and are not meant to be construed in a limiting sense. It is not intended that the invention be limited by the specific examples provided within the specification. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

What is claimed is:

1. A method of compensating for change in pixel performance, comprising:

dividing pixels into groups including a previous group L–1, a current group L and a next group L+1;

determining a first converged value $A_{converged}[L]$ and a second converged value $B_{converged}[L]$ for each pixel in the current group L starting with a first initial value $A_0[L]$ and a second initial value $B_0[L]$;

for each pixel in the current group L, determining a first moving average $A_{mean}[L]$ and a second moving average $B_{mean}[L]$ as follows:

$$A_{mean}[L] = \frac{A\ \text{mean}[L-1](K-1)+A[L]}{K},$$

$$B_{mean}[L] = \frac{B\ \text{mean}[L-1](K-1)+B[L]}{K},$$

wherein $A_{mean}[L-1]$ is a first moving average of a pixel in the corresponding column in the previous group L–1, $B_{mean}[L-1]$ is a second moving average of a pixel in the corresponding column in the previous group L–1, and K is a moving average window;

for the next group L+1, setting a first initial value $A_0[L+1]$ and a second initial value $B_0[L+1]$ of each pixel to $A_{mean}[L]$ and $B_{mean}[L]$.

2. The method of claim 1, wherein the pixels are arranged in rows and each of the previous group L–1, the current group L and the next group L+1 is one of the rows.

3. The method of claim 1 further comprising determining the first initial value $A_0[L]$ and the second initial value $B_0[L]$ for each pixel based on $A_{mean}[L-1]$ and $B_{mean}[L-1]$.

4. The method of claim 3 further comprising setting the moving averages $A_{mean}[L]$ and $B_{mean}[L]$ to $A_{converged}[L]$ and $B_{converged}[L]$ for the current group L upon determining that there is no previous group L–1.

5. The method of claim 1 further comprising changing a gear setting for convergence to $A_{converged}[L]$ and $B_{converged}[L]$ according to speed of convergence.

6. The method of claim 1, wherein the determining of a first converged value $A_{converged}[L]$ and a second converged value $B_{converged}[L]$ for each pixel comprises:

for each pixel in the current group L, iteratively determining a modified code $R_n=A_nG_n+B_n$ wherein $G_n$ is an input code and n indicates an iteration, and first iteration is done using the first initial value $A_0[L]$ and the second initial value $B_0[L]$ as $A_n$ and $B_n$.

7. The method of claim 6, wherein the determining of the first converged value $A_{converged}[L]$ and the second converged value $B_{converged}[L]$ for each pixel comprises:

for each pixel in the current group L, applying the modified code Rn to generate pixel current $I_{pixel}$, by substituting $R_n$ into $V_{gs0}$ wherein $I_{pixel}=\mu_0 k(V_{gs0}-V_{th0})^{\alpha}$;

comparing $I_{pixel}$ with a predefined reference current value $I_{reference}$ to generate ΔI;

adjusting $A_n$ and $B_n$ for each pixel in the group L, based on ΔI and step size;

determining $R_{mean,n}$ for pixels in the current group L;

determining a difference $R_{diff}$ for each pixel in the current group L, wherein $R_{diff}$ is a difference between $R_{mean}$ for current window of WIN iterations and $R_{mean}$ for previous window; and changing step size if $R_{diff}$ satisfies a limit threshold.

8. The method of claim 7 further comprising adjusting at least one of the limit threshold and the window size.

9. The method of claim 7, wherein changing the step size comprises adjusting to a smaller step size if $R_{diff}<Limit_n$.

10. The method of claim 9 further comprising determining the first converged value $A_{converged}$ and the second converged value $B_{converged}$ for each pixel in the current group L based on the latest first value $A_n$ and the second value $B_n$ if there is no next gear size.

11. The method of claim 7 further comprising performing a WIN number of iterations before determining the difference $R_{diff}$.

12. A display device comprising:

a plurality of pixels, each of the pixels including a light emitting element, wherein the light emitting element is coupled to a transistor that is controlled by a gate voltage $V_{gs}$;

circuitry configured to adjust the gate voltage $V_{gs}$ by:

dividing the pixels into groups including a previous group L–1, a current group L and a next group L+1;

determining a first converged value $A_{converged}[L]$ and a second converged value $B_{converged}[L]$ for each pixel in the current group L starting with a first initial value $A_0[L]$ and a second initial value $B_0[L]$;

for each pixel in the current group L, determining a first moving average $A_{mean}[L]$ and a second moving average $B_{mean}[L]$ as follows:

$$A_{mean}[L] = \frac{A\ \text{mean}[L-1](K-1)+A[L]}{K},$$

$$B_{mean}[L] = \frac{B\ \text{mean}[L-1](K-1)+B[L]}{K},$$

wherein $A_{mean}[L-1]$ is a first moving average of a pixel in the corresponding column in the previous group L–1, $B_{mean}[L-1]$ is a second moving average of a pixel in the corresponding column in the previous group L–1, and K is a moving average window;

for the next group L+1, setting a first initial value $A_0[L+1]$ and a second initial value $A_0[L+1]$ of each pixel to $A_{mean}[L]$ and $B_{mean}[L]$.

13. The display device of claim 12, wherein the pixels are arranged in rows and each of the previous group L–1, the current group L and the next group L+1 is one of the rows.

14. The display device of claim 12, wherein the circuitry is configured to adjust the gate voltage Vgs by setting the moving averages $A_{mean}[L]$ and $B_{mean}[L]$ to $A_{converged}[L]$ and $B_{converged}[L]$ for the current group L upon determining that there is no previous group L−1.

15. The display device of claim 12, wherein the circuitry is configured to change a gear setting for convergence to $A_{converged}[L]$ and $B_{converged}[L]$ according to speed of convergence.

16. The display device of claim 12, wherein the circuitry is configured to determine the first converged value $A_{converged}[L]$ and the second converged value $B_{converged}[L]$ for each pixel by:

for each pixel in the current group L, applying the modified code Rn to generate pixel current $I_{pixel}$, by substituting $R_n$ into $V_{gs0}$ wherein $I_{pixel}=\mu_0 k(V_{gs0}-V_{th0})^{\alpha}$;

comparing $I_{pixel}$ with a predefined reference current value $I_{reference}$ to generate ΔI;

adjusting $A_n$ and $B_n$ for each pixel in the group L, based on ΔI and step size;

determining $R_{mean,n}$ for pixels in the current group L;

determining a difference $R_{diff}$ for each pixel in the current group L, wherein $R_{diff}$ is a difference between $R_{mean}$ for current window of WIN iterations and $R_{mean}$ for previous window; and changing step size if $R_{diff}$ satisfies a limit threshold.

17. The display device of claim 16, wherein the circuitry is configured to adjust at least one of the limit threshold and the window size.

18. The display device of claim 16, wherein the circuitry is configured to change the step size by adjusting to a smaller step size if $R_{diff}<Limit_n$.

19. The display device of claim 18, wherein the circuitry is configured to determine the first converged value $A_{converged}$ and the second converged value $B_{converged}$ for each pixel in the current group L based on the latest first parameter value $A_n$ and the second parameter value $B_n$ if there is no next gear size.

20. The display device of claim 16, wherein the circuitry is configured to perform the WIN number of iterations before determining the difference $R_{diff}$.

* * * * *